US005409374A

United States Patent [19]

Liard

[11] Patent Number: 5,409,374

[45] Date of Patent: Apr. 25, 1995

[54] CLIPPING ATTACHMENT FOR LIGHTERS

[76] Inventor: Michel Liard, 1317 Charlemagne, Joliette, Quebec, Canada, J6E 7Z1

[21] Appl. No.: 128,773

[22] Filed: Sep. 30, 1993

[51] Int. Cl.[6] ..... F23Q 1/04

[52] U.S. Cl. ..... 431/253; 431/142; 206/236; 206/85; D27/142

[58] Field of Search ..... 431/253, 278, 153, 142, 431/143; 131/329, 178, 185, 186, 187–190, 242, 248, 250, 251, 250.1, 252; 206/236, 85; D27/142; 24/10 R, 11 HC; 224/230

[56] References Cited

U.S. PATENT DOCUMENTS

| | | | |
|---|---|---|---|
| D. 313,085 | 12/1990 | Eisenbraun | D27/142 |
| 1,862,518 | 6/1932 | Alland | 431/253 X |
| 3,057,180 | 10/1962 | Steppan | 431/253 X |
| 3,178,016 | 4/1965 | Coats | 431/253 X |
| 4,278,185 | 7/1981 | Perez | 221/104 |
| 4,579,222 | 4/1986 | Olazábal | 206/87 |
| 4,844,254 | 7/1989 | Jang | 431/253 X |
| 5,277,315 | 1/1994 | Plein | 206/270 |

*Primary Examiner*—Larry Jones

[57] ABSTRACT

A clipping attachment for releasably fixing a cigarette lighter to a substantially parallelepiped-shaped pack of cigarettes having an outer jacket and an inner sleeve. The outer jacket of the cigarette pack having a front wall, a back wall, and a pair of opposite side walls. The inner sleeve of the cigarette pack being adapted to slidably move up and down relatively to the outer jacket in order to respectively allow access to the cigarettes and to prevent access to the latter. The clipping attachment has a substantially elongated and flat tongue adapted to be slidably inserted between the inner sleeve and one of the side walls of the outer jacket. A spacing section extends substantially perpendicullarly from the top end of the tongue for spacing the tongue from the lighter. A fixing device for fixing the clipping attachment to the lighter extends integrally from the spacing section.

4 Claims, 4 Drawing Sheets

CLIPPING ATTACHMENT FOR LIGHTERS

This invention relates to flame type lighters such as conventional cigarette lighters and is particularly concerned with a clipping member for realasably attaching the lighter to a conventional pack of cigarettes.

BACKGROUND OF THE INVENTION

Most cigarette smokers own a so-called cigarette lighter which usually consists of a combutible reservoir to which is fixed an ignition mechanism usualy in the form of a friction wheel the rough surface of which rubs against a flint for producing a spark. The spark in turn lights up a wick.

Altough these cigarette lighters come in a variety of shapes and sizes, they are increasingly sold as small disposable units which are adapted to be handheld and carried around in the clothing pocket or purse of the user.

Because of the relatively small size of contemporary cigarette lighters, the latter have a tendency to be quite frequently misplaced. As a result, when a given smoker experiences an urge to smoke, he or she must often also experience the frustration of not finding the cigarette lighter which would satisfy the lighted cigarette craving.

SUMMARY OF THE INVENTION

Accordingly, the present invention proposes a clipping attachment specifically sized and configured to allow a user to releasably attach a cigarette lighter to a conventional cigarette pack. The clipping attacment embodying the invention conforms to conventional forms of manufacturing and is easy to use thus providing a clipping attacment which is economically feasable while efficient and ergonomical.

The present invention thus proposes a clipping attachment for releasably fixing a cigarette lighter having a combustible reservoir with a combustible reservoir cover to a substantially parallelepiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said clipping attachment comprising: a substantially elongated and flat tongue adapted to be slidably inserted between said inner sleeve and one of said side walls of said outer jacket, said tongue having a top end and a bottom end, a spacing section extending substantially perpendicullarly from said top end of said tongue, a fixing means for fixing said clipping attachment to said lighter extending integrally from said spacing section.

Conveniently, said tongue has a top section and a lower section angled relatively to said top section, said bottom end of said tongue thus being adapted to frictionnally abut against said inner sleeve when said tongue is inserted between said inner sleeve and one of said walls of said outer jacketsaid bottom end thus acting as a releasable braking means for releasably preventing an unwanted withdrawal of said tongue from said cigarette pack.

Preferrably, said tongue has a tapered configuration from top to bottom, the width of said top end being greater then the width of said bottom end.

Also preferrably, said spacing section has a lenght substantially equivalent to the thichkness of said front, back and side walls of said outer jacket, said spacing section being adapted to override one of said side walls of said outer jacket.

According to one embodiment, said fixing means is a fixing cover having a configuration substantially similar to the configuration of said combustible reservoir cover, wherein a user can replace said combustible reservoir cover with said fixing cover.

According to a second embodiment of the invention, said fixing means is a fixing plate extending integrally and substantially ortogonally from said spacing section, said fixing plate having a face facing said tongue and a face facing away from said tongue, said fixing plate being provided with a strip of adhesive material on its face facing away from said tongue, said adhesive strip being adapted to be adhesively fixed to said lighter.

According to a third embodiment of the invention, said fixing means is a lip extending integrally and orthogonally from said spacing section, said lip being adapted to be inserted into the structure of said lighter.

According to a fourth embodiment of the invention, said fixing means is a substantially "U"-shaped clip extending integrally from said spacing section, said clip having a relatively flat cylindrical wall correspondingly configured to fittingly grasp the outer periphery of said combustible reservoir, said wall being provided with an expension slot.

The present invention also proposes a cigarette lighter having a clipping attachment cover for releasably fixing said lighter to a substantially parallelepiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said cigarette lighter having a combustible reservoir with a combustible reservoir cover, said clipping attachment comprising: a substantially elongated and flat tongue adapted to be slidably inserted between said inner sleeve and one of said side walls of said outer jacket, said tongue having a top end and a bottom end, a spacing section extending substantially perpendicullarly from said top end of said tongue, said spacing section extending from said lighter.

Conveniently, said tongue has a top section and a lower section angled relatively to said top section, said bottom end of said tongue thus being adapted to frictionnally abut against said inner sleeve when said tongue is inserted between said inner sleeve and one of said walls of said outer jacketsaid bottom end thus acting as a releasable braking means for releasably preventing an unwanted withdrawal of said tongue from said cigarette pack.

BRIEF DESCRIPTION OF THE DRAWINGS

The present invention will be further understood from the following description with reference to the drawings in which.

Figure 1:
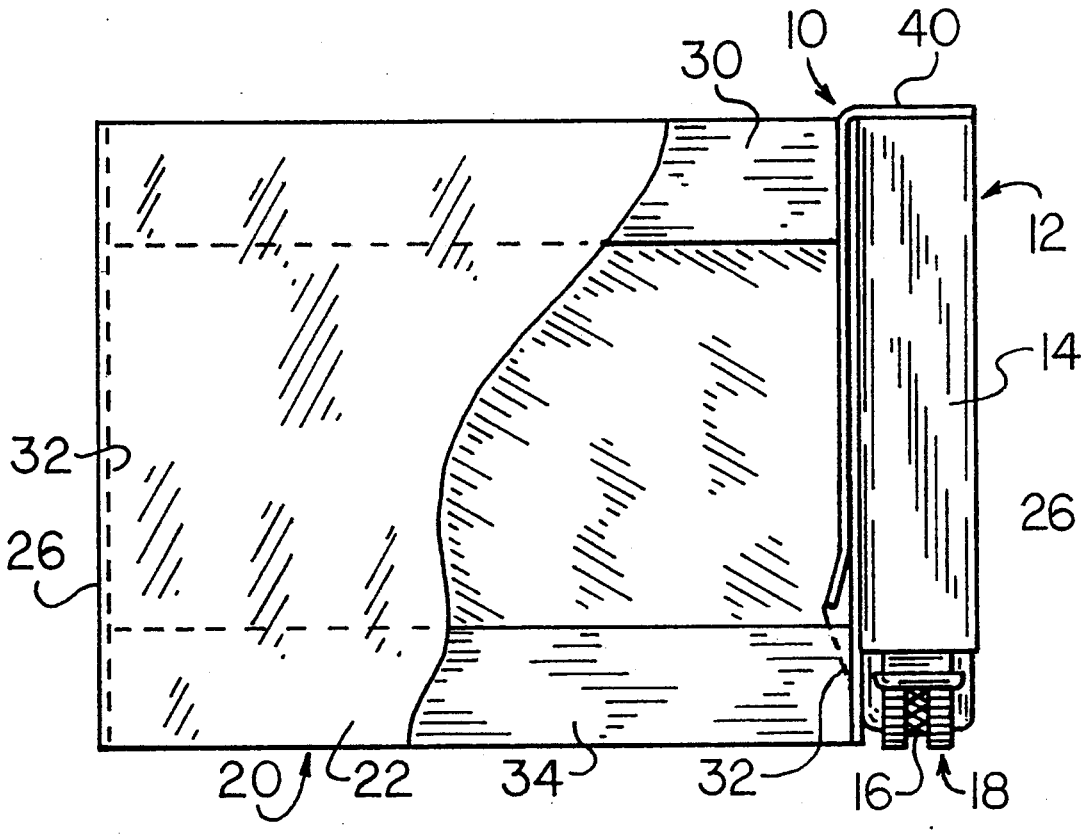
FIG. 1, in an elevational view witha cut-out section, illustrates a clipping attachment in accordance with a first embodiment of the present invention mounted on a conventional lighter and releasably fixed to the side of a conventional pack of cigarettes.

Similar references are used in different figures to denote similar components.

DETAILED DESCRIPTION

Referring to FIGS. 1 through 6, there is illustrated in an elevational view, a clipping attachment 10 in accordance with a first embodiment of the present invention.

The clipping attachment 10 is mounted on a conventional cigarette lighter 12 having a combustible reservoir 14, and a friction wheel 16 part of an ignition mechanism 18. The clipping attachment 10 allows the lighter 12 to be releasably fixed to a conventional substantially parallelepiped shaped pack of cigarettes 20 having an outer jacket and an inner sleeve.

The outer jacket of the cigarette pack 20 has a front wall 22, a back wall 24 and a pair of opposite side walls 26. The inner sleeve of the cigarette pack 20 is adapted to slidably move up and down relatively to the outer jacket in order to respectively allow access to the cigarettes and to prevent access to the latter. The inner sleeve comprises a back wall 28, a substantially "L"-shaped top flap 30, a pair of opposed side flaps 32 and a substantially "L"-shaped bottom flap 34, the flaps 30, 32 and 34 all extending integrally from the back wall 28.

The clipping attachment 10 has a clipping tongue 36 extending integrally and substantially orthogonally into a spacing section 38. The spacing section 38 extends integrally into a fixing cover 40. The fixing cover 40 is adapted to be snappingly fixed to the bottom of the combustible reservoir 14 of the lighter 12 in place of the conventional bottom cover of the ligther 12. The clipping tongue 36 has a relatively elongated and flat body 42 which extends integrally into a lower section 44 also relatively flat but angled relatively to the elongated body 42.

Figure 5:
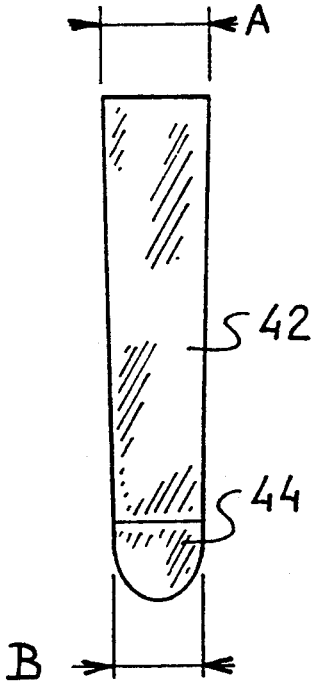
FIG. 5, in a side view, illustrates a clipping attachment in accordance with a first embodiment of the present invention.

As illustrated more specifically in FIG. 5, the clipping tongue 36 is taperred from top to bottom, the width indicated by the reference letter A of the body 42 at its upper end being greater then the width indicated by the reference letter B of the lower section 44 adjacent its lower end.

Figure 6:
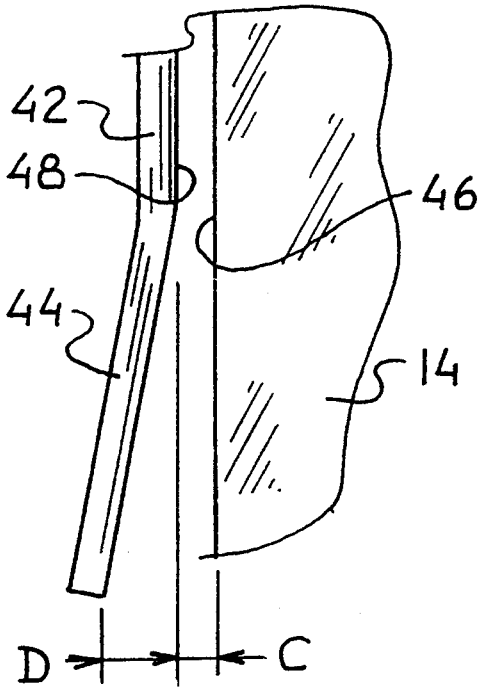
FIG. 6, in a detail elevational view taken inside arrow 6 of FIG. 5 illustrates the spacing between the tongue of the clipping attachment and the lighter.

As illustrated more specifically in FIG. 6, the spacing section 38 creates a spacing indicated by the reference letter C between a side wall 46 of the combustible reservoir 14 and the inner surface 48 of the body 42. The inclination of the lower section 44 which projects the latter away from the side wall 46 creates a spacing indicated by the reference letter D between the lower end of the lower section 44 and the inner surface 48 of the body 42. The clipping tongue 36 and the spacing section 38 are preferably made of relatively resilient material such as soft metals or flexible polymeric resins.

Figure 2:
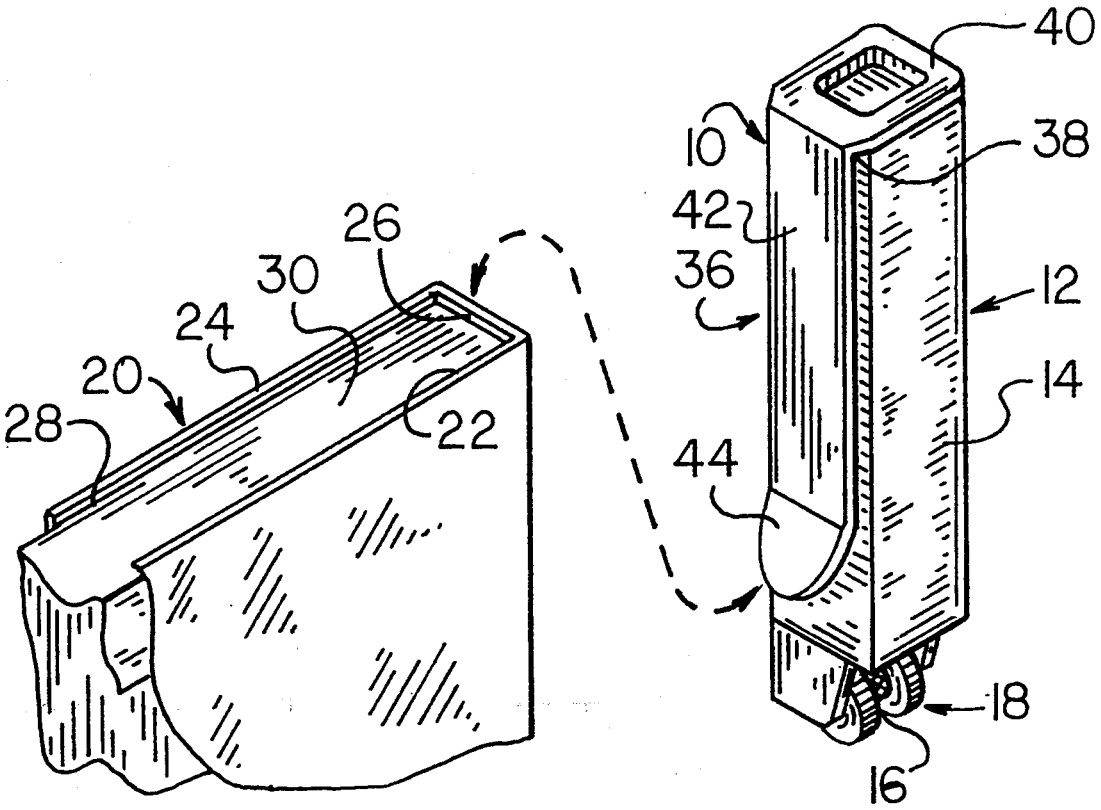
FIG. 2, in a perspective view, illustrates a clipping attachment in accordance with a first embodiment of the present invention mounted on a conventional lighter and about to be fixed to the side of a conventional pack of cigarette.
Figure 3:
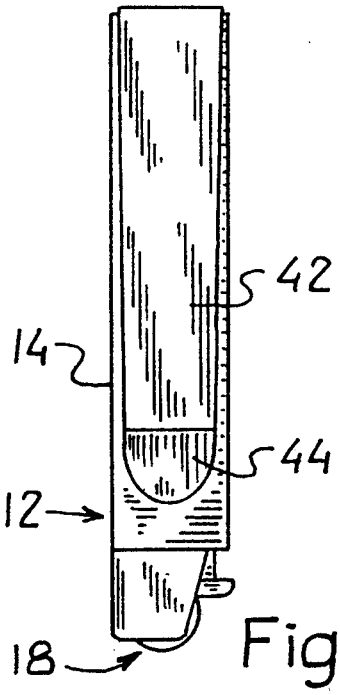
FIG. 3, in a side view, illustrates a clipping attachment in accordance with a first embodiment of the present invention mounted on a conventional lighter.
Figure 4:
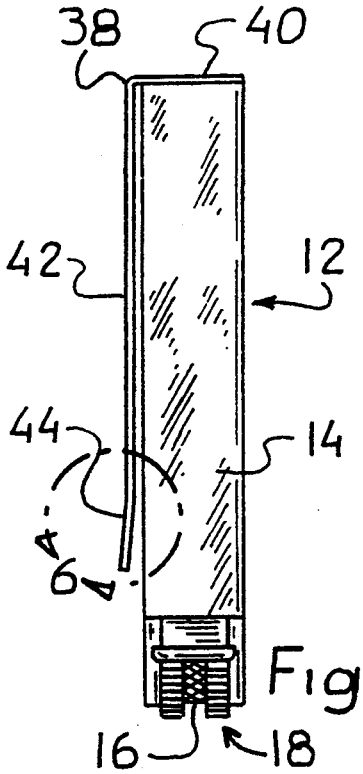
FIG. 4, in an elevational view, illustrates a clipping attachment in accordance with a first embodiment of the present invention mounted on a conventional lighter.

In use, as illustrated in FIGS. 1 and 2, the clipping tongue 36 is adapted to be slidably inserted in the cigarette pack 20 between a side wall 26 of the outer jacket and a corresponding adjacent side flap 32 of the inner sleeve. The spacing section 38 is specifically sized to create a spacing C substantially corresponding to the tichkness of the side wall 26 of a conventional pack of cigarette. The width a is also specifically sized so as to correspond substantially to the thichkness of inner sleeve of a conventional pack of cigarette. This allows the tongue 36 to be fittingly inserted inside the cigarette pack without damaging the latter.

The taper configuration of the tongue 36 is adapted to facilitate its insertion into the cigarette pack. The angle between the flat body 42 and the lower section 44 is adapted both to facilitate insertion of the tongue in an ergonomical fashion and to to provide for a releasable means for preventing unwanted withdrawal of the tongue 36 from the cigarette pack. Indeed, The angled nature of the lower section 44 relatively to the body 42 provides for a greater potential contact surface with the cigarette pack during the initial contact between the tongue 36 and the cigarette pack 20. This facilitates the guiding of the tongue 36 inside the relatively narrow spacing between the side wall 26 and the side flap 32 of the cigarette pack 20. Once the initial contact is made, the user merely needs to push the lighter downwardly relatively to the cigarette pack 20 in order to complete the insertion procedure.

Furthermore, the angled nature of the lower section 44 relatively to the body 42 allows for the tip portion 45 of the lower section 44 to frictionally abut against a side flap 32 of the inner sleeve once the tongue has been inserted. This frictional abutment releasably prevents the tongue 36 from unvoluntarily sliding out of the cigarette pack 20.

Figure 7:
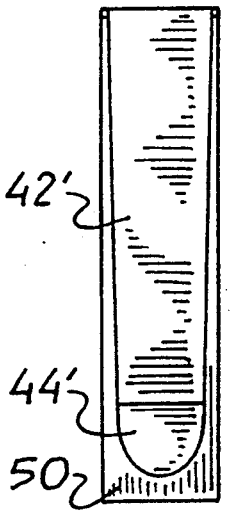
FIG. 7, in an elevational view, illustrates a clipping attachment in accordance with a second embodiment of the present invention.
Figure 8:
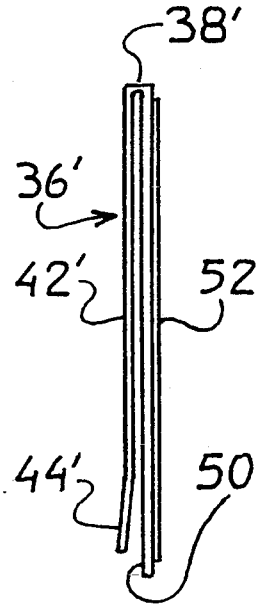
FIG. 8, in a side view, illustrates a clipping attachment in accordance with a second embodiment of the present invention.
Figure 9:
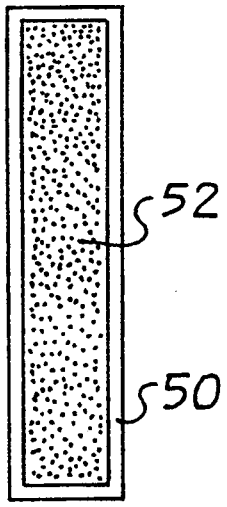
FIG. 9, in a back view, illustrates a clipping attachment in accordance with a second embodiment of the present invention.

FIGS. 7 through 9 illustrate a second embodiment 10' of the invention wherein the spacing section 38' extends integrally into a fixing plate 50. The fixing plate 50 is substantially parallel to the body 42'. The fixing plate 50 is provided with a strip 52 of adhesive material on its face opposite the tongue 36'. The adhesive strip 52 is adapted to be adhesively fixed to a side wall 46 of the lighter 12 for fixing the clipping attachment 10' to the lighter 12.

Figure 10:
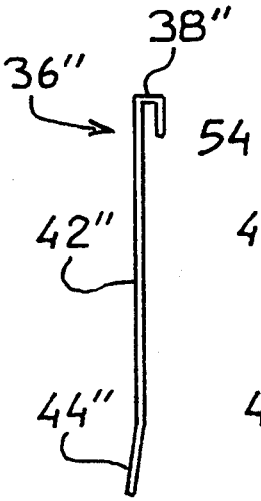
FIG. 10, in a side view, illustrates a clipping attachment in accordance with a third embodiment of the present invention.
Figure 11:
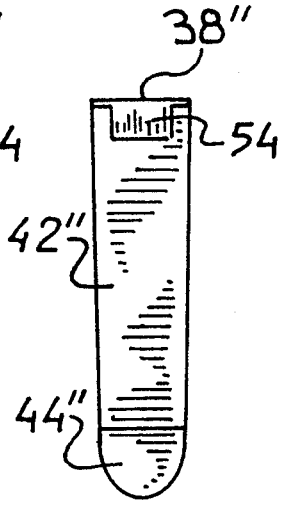
FIG. 11, in a back view, illustrates a clipping attachment in accordance with a third embodiment of the present invention.

FIGS. 10 and 11 illustrate a third embodiment 10'' of the invention wherein the spacing section 38'' extends integrally into a lip 54 substantially parallel to the body 42''. The lip 54 is adapted to be slidably inserted into the structure of the lighter 12 preferably between the cover and one of the side walls of the combustible reservoir, for fixing the clipping attachment 10'' to the lighter 12.

Figure 12:
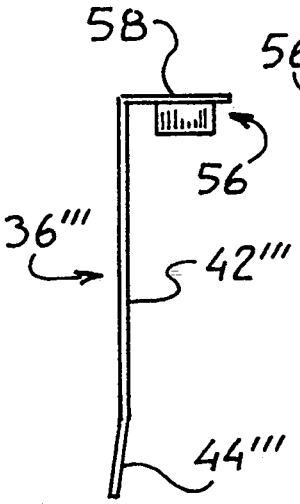
FIG. 12, in a side view, illustrates a clipping attachment in accordance with a fourth embodiment of the present invention.
Figure 13:
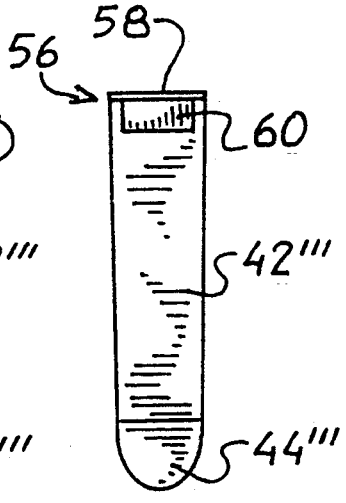
FIG. 13, in a back view, illustrates a clipping attachment in accordance with a fourth embodiment of the present invention.
Figure 14:
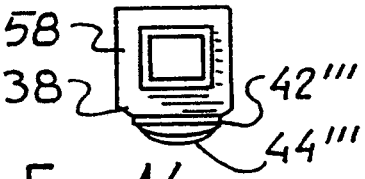
FIG. 14, in a top view, illustrates a clipping attachment in accordance with a fourth embodiment of the present invention.
Figure 18:
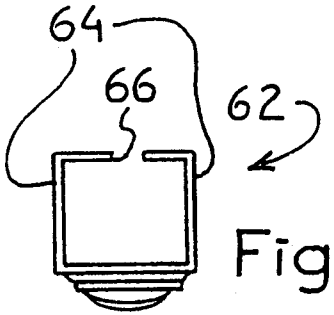
FIG. 18, in a top view, illustrates a clipping attachment in accordance with a fifth embodiment of the present invention and, FIG. 19, in a perspective view, illustrates a clipping attachment in accordance with a fifth embodiment of the present invention mounted on a conventional lighter.
Figure 15:
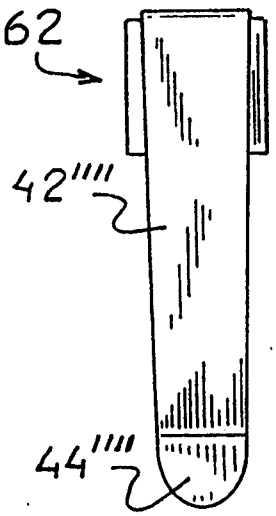
FIG. 15, in an elevational view, illustrates a clipping attachment in accordance with a fifth embodiment of the present invention.
Figure 16:
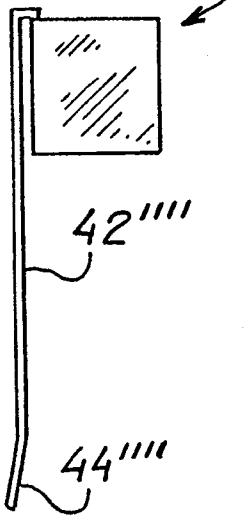
FIG. 16, in a side view, illustrates a clipping attachment in accordance with a fifth embodiment of the present invention.
Figure 17:
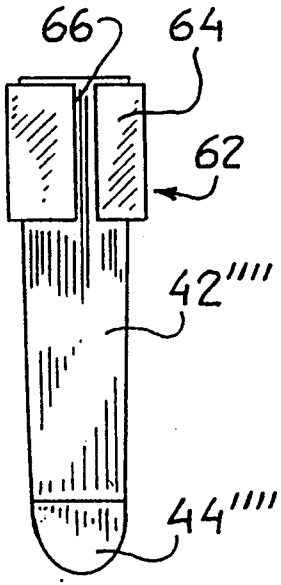
FIG. 17, in a back view, illustrates a clipping attachment in accordance with a fifth embodiment of the present invention.
Figure 19:
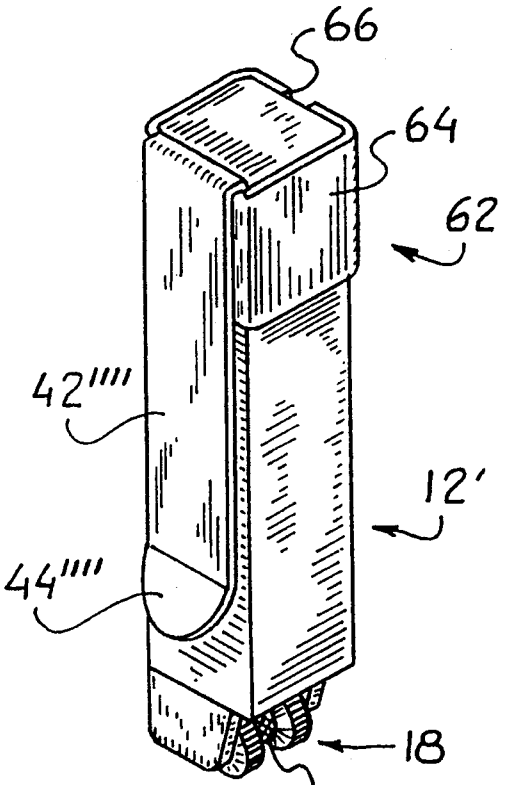

FIGS. 12 through 14 illustrate a fourth embodiment of the invention 10''' wherein the spacing section 38''' extends integrally into a cover 56 adapted to be positionned in place of the conventional combustible reservoir cover of a conventional lighter. In other words, the fourth embodiment 10''' provides a means for replacing the conventional cover of a lighter which would not have a clipping attachment with a cover 56 having an integral tongue 36'''. The resulting structure is similar to the structure illustrated in FIGS. 1 through 6 wherein the clipping attachment is incorporated during the manufacturing process of the lighter. The cover 56 has a top wall 58 and a prong 60 extending integrally from the lower surface of the wall 58. The prong 60 is adapted to be inserted in the combustible reservoir of a conventional lighter for fittingly fixing the clipping attachment 10''' to the lighter.

FIGS. 15 to 19 illustrate a fifth embodiment of the invention 10'''' wherein a substantially "U"-shaped clip 62 is used to releasably secure the clipping attacment 10'''' to a conventional lighter 12'. The "U"-shaped clip 62 extends integrally from the spacing section 38''''. The clip 62 has a relatively flat cylindrical wall 64 correspondingly configured to fittingly grasp the outer periphery of the combustible reservoir 14' of the lighter 12'. The wall 62 is preferrably made of relatively resilient material and is provided with an expension slot 66.

Numerous modifications, variations and adaptations may be made to the particular embodiments of the invention described above without departing from the scope of the invention, which is defined in the claims.

The embodiments of the invention in which an exclusive property or priviledge is claimed are defined as follows:

1. A clipping attachment for releasably fixing a cigarette lighter having a combustible reservoir with a combustible reservoir cover to a substantially parallelpiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said clipping attachment comprising:

a substantially elongated and flat tongue adapted to be slidably inserted between said inner sleeve and one of said side walls of said outer jacket, said tongue having a top end and a bottom end, a spacing section extending substantially perpendicullarly from said top end of said tongue, a fixing means for fixing said clipping attachment to said lighter extending integrally from said spacing section, said tongue having a top section and a lower section angled relatively to said top section, said bottom end of said tongue thus being adapted to frictionally abut against said inner sleeve when said tongue is inserted between said inner sleeve and one of said walls of said outer jacket, said bottom end thus acting as a releasable braking means for releasably preventing an unwanted withdrawal of said tongue from said cigarette pack, said tongue having a tapered configuration from top to bottom, the width of said top end being greater then the width of said bottom end, said spacing section having a length substantially equivalent to the thichkness of said front, back and side walls of said outer jacket, said spacing section being adapted to override one of said side walls of said outer jacket, said fixing means being a fixing cover having a configuration substantially similar to the configuration of said combustible reservoir cover, wherein a user can replace said combustible reservoir cover with said fixing cover.

2. A clipping attachment for releasably fixing a cigarette lighter having a combustible reservoir with a combustible reservoir cover to a substantially parallelpiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said clipping attachment comprising:

a substantially elongated and flat tongue adapted to be slidably inserted between said inner sleeve and one of said side walls of said outer jacket, said tongue having a top end and a bottom end, a spacing section extending substantially perpendicullarly from said top end of said tongue, a fixing means for fixing said clipping attachment to said lighter extending integrally from said spacing section, said tongue having a top section and a lower section angled relatively to said top section, said bottom end of said tongue thus being adapted to frictionally abut against said inner sleeve when said tongue is inserted between said inner sleeve and one of said walls of said outer jacket, said bottom end thus acting as a releasable braking means for releasably preventing an unwanted withdrawal of said tongue from said cigarette pack, said tongue having a tapered configuration from top to bottom, the width of said top end being greater then the width of said bottom end, said spacing section having a lenght substantially equivalent to the thichkness of said front, back and side walls of said outer jacket, said spacing section being adapted to override one of said side walls of said outer jacket, said fixing means being a fixing plate extending integrally and substantially orthogonally from said spacing section, said fixing plate having a face facing said tongue and a face facing away from said tongue, said fixing plate being provided with a strip of adhesive material on its face facing away from said tongue, said adhesive strip being adapted to be adhesively fixed to said lighter.

3. A clipping attachment for releasably fixing a cigarette lighter having a combustible reservoir with a combustible reservoir cover to a substantially parallelepiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said clipping attachment comprising:

a substantially elongated and flat tongue adapted to be slidably inserted between said inner sleeve and one of said side walls of said outer jacket, said tongue having a top end and a bottom end, a spacing section extending substantially perpendicullarly from said top end of said tongue, a fixing means for fixing said clipping attachment to said lighter extending integrally from said spacing section, said tongue having a top section and a lower section angled relatively to said top section, said bottom end of said tongue thus being adapted to frictionally abut against said inner sleeve when said tongue is inserted between said inner sleeve and one of said walls of said outer jacket, said bottom end thus acting as a releasable braking means for releasably preventing an unwanted withdrawal of said tongue from said cigarette pack, said tongue having a tapered configuration from top to bottom, the width of said top end being greater then the width of said bottom end, said spacing section having a length substantially equivalent to the thichkness of said front, back and side walls of said outer jacket, said spacing section being a adapted to override one of said side walls of said outer jacket, said fixing means being a lip extending integrally and orthogonally from said spacing section, said lip being adapted to be inserted into the structure of said lighter.

4. A clipping attachment for releasably fixing a cigarette lighter having a combustible reservoir with a combustible reservoir cover to a substantially parallelpiped shaped pack of cigarettes having an outer jacket and an inner sleeve, the outer jacket of the cigarette pack having a front wall, a back wall, and a pair of opposite side walls, the inner sleeve of the cigarette pack being adapted to slidably move up and down relatively to the outer jacket in order to respectively allow access to the cigarettes and to prevent access to the latter, said clipping attachment comprising:

a substantially elongated and flat tongue adapted to be slidably inserted between said inner sleeve and one of said side walls of said outer jacket, said tongue having a top end and a bottom end, a spacing section extending substantially perpendicullarly from said top end of said tongue, a fixing means for fixing said clipping attachment to said lighter extending integrally from said spacing section, said tongue having a top section and a lower section angled relatively to said top section, said bottom end of said tongue thus being adapted to frictionally abut against said inner sleeve when said tongue is inserted between said inner sleeve and one of said walls of said outer jacket, said bottom end thus acting as a releasable braking means for releasably preventing an unwanted withdrawal of said tongue from said cigarette pack, said tongue having a tapered configuration from top to bottom, the width of said top end being greater then the width of said bottom end, said spacing section having a length substantially equivalent to the thichkness of said front, back and side walls of said outer jacket, said spacing section being adapted to override one of said side walls of said outer jacket, said fixing means being a substantially "U"-shaped clip extending integrally from said spacing section, said clip having a relatively flat cylindrical wall correspondingly configured to fittingly grasp the outer periphery of said combustible reservoir, said wall being provided with an expension slot.

* * * * *